US012523438B2

(12) United States Patent
Morsa

(10) Patent No.: US 12,523,438 B2
(45) Date of Patent: Jan. 13, 2026

(54) AUTOMATED SYSTEM AND METHOD FOR A PROJECTILE LAUNCHER MONITORING

(71) Applicant: FN HERSTAL S.A., Herstal (BE)

(72) Inventor: Nathan Morsa, Liège (BE)

(73) Assignee: FN HERSTAL S.A., Herstal (BE)

( * ) Notice: Subject to any disclaimer, the term of this patent is extended or adjusted under 35 U.S.C. 154(b) by 0 days.

(21) Appl. No.: 18/857,144

(22) PCT Filed: Apr. 24, 2023

(86) PCT No.: PCT/EP2023/060674
§ 371 (c)(1),
(2) Date: Oct. 15, 2024

(87) PCT Pub. No.: WO2023/208853
PCT Pub. Date: Nov. 2, 2023

(65) Prior Publication Data

US 2025/0271230 A1 Aug. 28, 2025

(30) Foreign Application Priority Data

Apr. 28, 2022 (EP) ..... 22170640

(51) Int. Cl.
*F41A 19/01* (2006.01)

(52) U.S. Cl.
CPC ..... *F41A 19/01* (2013.01)

(58) Field of Classification Search
CPC .... F41A 19/01; G06N 3/0442; G06N 3/0464; G06N 3/0495; G06N 3/09
(Continued)

(56) References Cited

U.S. PATENT DOCUMENTS 7,669,356 B2 3/2010 Joannes et al.
10,424,048 B1 9/2019 Calhoun et al.
(Continued)

FOREIGN PATENT DOCUMENTS

WO WO-2019224781 A2 * 11/2019 ..... F41G 9/00

OTHER PUBLICATIONS

International Search Report and Written Opinion of the International Searching Authority from the European Patent Office, in PCT/EP2023/060674 dated Apr. 24, 2023, of which this application is a national phase entry.

*Primary Examiner* — Sonji N Johnson
(74) *Attorney, Agent, or Firm* — Kolitch Romano Dascenzo Gates LLC

(57) ABSTRACT

An automated projectile launcher monitoring system includes a projectile attachment and a processing module. The projectile attachment, coupled with a projectile launcher, includes a sensor module and a communication module. The projectile attachment acquires signals from the sensor module and converts them into time-sampled data, which is sent to the processing module corresponding to a shooting plan. The processing module is coupled with the projectile attachment and configured to process the time-sampled data to generate a monitoring model. The processing module produces shot candidate(s) from the time-sampled data when at least one metric is satisfied, and deploys an instance-level classifier to categorize the shot candidate(s) to generate prediction(s). The processing module further computes an estimated proportion by aggregating the prediction(s), compares the estimated proportion with a real proportion to determine a loss function, and generates the monitoring model through an iterative process until a predetermined minimal loss is achieved.

15 Claims, 7 Drawing Sheets

(58) Field of Classification Search
USPC ..... 235/400
See application file for complete search history.

(56) References Cited

U.S. PATENT DOCUMENTS

| | | | | |
|---|---|---|---|---|
| 2009/0277065 | A1* | 11/2009 | Clark | F41A 19/01 42/1.03 |
| 2019/0213771 | A1* | 7/2019 | Deng | G06T 13/20 |
| 2020/0141697 | A1* | 5/2020 | Sullivan | F41G 3/142 |
| 2021/0199400 | A1 | 7/2021 | Weiss et al. | |

* cited by examiner

AUTOMATED SYSTEM AND METHOD FOR A PROJECTILE LAUNCHER MONITORING

FIELD

The present disclosure generally relates to projectile launchers such as firearms, in particular to a system and a method for projectile launcher monitoring.

BACKGROUND

The number of shots fired by a weapon is the prime contributor to its deterioration. Therefore, counting the number of shots fired becomes a critical parameter for quantitative performance measurement of a weapon or a projectile launcher as it allows a quantitative measure of wear and tear. The number of fired shots further helps predict maintenance schedules, manage inventory, label dataset, determine shot type, etc. Initially, the operators used to maintain shot counting data manually through logbooks. However, relying solely on the manually collected data led to unsatisfactory results. Manual data entries were prone to human error and might be omitted or subject to inaccurate estimations. Further, there was no finite way to determine the end of the usable life of a specific component of a weapon or a projectile launcher. The most common method of determining the shelf-life of a particular component of the projectile launcher was a visual inspection or when the projectile launcher failed during firing.

Electronic shot counters were introduced to accurately track the individual projectile launcher's usage. The operators could maintain their inventory by prioritizing weapons that need the most maintenance and potentially skipping those which have not been operated since their previous maintenance. In addition, the shot counter can provide alerts to the operator in advance, and the operators can maintain a specific component based on the manufacturer-provided guidelines or replace the defective part. As a result, the potential failure of the projectile launcher during operation can be avoided.

Moreover, projectile launchers or weapons are usually produced in high volume and sold in a configuration primarily identical to the original design. Nowadays, the defense industry expects a higher grade of personalization, including modifications impacting the core design of the weapon and necessitating new R&D work, testing, and qualification. On the other hand, the customer expects fast product delivery in an increasingly competitive market. This has led to a fundamental restructuring of the manufacturing processes from make-to-stock to assemble-to-order and even engineer-to-order strategies. Thus, a projectile launcher monitoring system can only be developed when a corresponding design prototype is available. Therefore, the time left for developing a shot counter between the end of R&D work and the first delivery is very short. Ideally, when the projectile launcher prototype is delivered to the client for initial testing, the evaluation of the projectile launcher could be performed alongside to reduce the time to market. It is thus growingly important for the shot counter to be available with a small delay.

In recent public tenders of the projectile launcher market, shot counters have progressively become an essential criterion in the attribution process. Increased complexity of the numerous existing projectile launcher variants is leading to a correspondingly high development time. As the market for shot counters develops within the projectile launcher industry, requests for new types of shot counters with higher customization and lower accepted lead time have increased. The current techniques of manually written algorithms for electronic shot counters can result in failure to meet the market demand. Automating the shot counting algorithm generation aims to alleviate this issue by trading labor time from a qualified expert to computation time.

Over the years, various algorithms have been developed to count the number and type of shots fired. However, a database of sensor recordings needs to be maintained to develop shot detection algorithms. The raw data is generally acquired by recording the sensor output while the projectile launcher is in operating condition. However, the labelling of the sensor data presents a significant challenge. Creating strong labels for identifying the position of individual shots in the data requires expert knowledge in projectile launcher to discern shots from unrelated sensor events. It is a very labor-intensive task and is highly prone to human error.

U.S. Pat. No. 7,669,356 B2 to Joannes, et al, entitled "Device for detecting and counting shots fired by an automatic or semi-automatic firearm, and firearm equipped with such a device" is directed to a device for detecting and counting shots fired by an automatic or semi-automatic firearm with a barrel and moving parts to recock the firearm. The device, comprising of an accelerometer and a microprocessor, performs the embedded acceleration analysis to detect shot counting fired by an automatic or semi-automatic firearm. However, deriving a shot counting algorithm by itself is not discussed and highlighted explicitly.

U.S. Pat. No. 10,424,048 B1 to Calhoun, et al. entitled "Systems and methods involving the creation and/or utilization of image mosaic in the classification of acoustic events" is directed to a system and method for gunshot detection by utilizing image mosaic in the classification of acoustic events by using deep learning. This technique is based on the acoustic detection captured from a network of city-wide microphones, not on counting the gunshots. This technique does not solve the problem of embedded shot counting.

U.S. Patent Application Publication No. 2021/0199400 A1 to Weiss, et al, entitled "Device system and method for projectile launcher operation monitoring" directed to a system and method for shot counting by using accelerometer data. The system and method use deep learning techniques for shot counting. An encoder-decoder structure, with the encoder part being embedded in the firearm, aims to reduce the input into smaller features to be exploited by the decoder network. The decoder uses the generated codes to detect different mechanical events from the firearm, shots, and their type or changes in user status. The decoder is suggested to use statistical regression to infer other operational parameters such as projectile speed, barrel temperature, weapon condition, etc. A flow controller uses information from both networks to essentially perform out-of-distribution detection and early stopping. The flow controller is suggested to be implemented as neural networks, including Dilated Convolutional Neural Networks (D-CNN), RNNs, Gated Recurrent Unit (GRU), or Long Short-Term Memory (LSTM) networks. The system proposes continuous unsupervised optimization of the network parameters in order to ensure that the predictions of the network respect a pre-established distribution. Generative Adversarial Networks synthesize both shot and non-shot data along with distorted variations to generate training data. This allows the creation of a fully labelled dataset, if and only if the synthesized output is an accurate representation of the nature and distribution of real firearm data. However, analysis of the fully labelled dataset requires expert intervention. Also, the document does not disclose how the encoder input vectors are chosen and kept to a reasonable number for embedded usage, especially when the decoder is not part of the embedded device and thus cannot perform early stopping.

Although there are few systems and methods providing the use of machine learning algorithms for projectiles launchers monitoring, there is a need to have a shot counter that can be customized in a very short time without expert intervention.

SUMMARY

An object of the present disclosure is to provide a continuously improving automated projectile launcher monitoring system that comprises a technique to optimize data collection, reduce human intervention, and cut down the manufacturer's side effort. The present disclosure leverages the weak labels about the number of shots contained in a time-sampled sensor data to eliminate the human intervention.

According to the first aspect of the present disclosure, an automated projectile launcher monitoring system comprises a projectile attachment and a processing module. The projectile attachment coupled with the projectile launcher includes a sensor module to acquire signals and convert them into time-sampled data and a communication module to send and receive data to a processing module. The communication module is configured to receive a shooting plan and send the time sampled data corresponding to the shooting plan acquired through the sensor module. The processing module is coupled with the projectile attachment and configured to receive and process the time-sampled data to generate a monitoring model. The processing module produces at least one-shot candidate from the time-sampled data when at least one metric is satisfied and deploys an instance-level classifier to categorize the at least one shot candidate to generate at least one prediction. The processing module further computes an estimated proportion by aggregating the at least one prediction, compares the estimated proportion with a real proportion to determine a loss function, and generates the monitoring model through an iterative process until a predetermined minimal loss is achieved. In an embodiment, the projectile attachment and the processing module are integrated components.

In specific embodiments of the present disclosure, the sensor module includes at least one acceleration sensor responsive to measure the acceleration of the projectile launcher at a predetermined sample rate. The sensor module can also measure operational and external parameters of the projectile launcher by incorporating other sensors, including but not limited to the temperature sensor, GPS, barometer, gyroscope, compass, microphone, or photosensors.

In specific embodiments of the present disclosure, the processing module calculates the rolling average of the squared acceleration in a predetermined time window and determines the occurrence of the at least one shot candidate when the rolling average is transitioning from a predetermined low threshold to a predetermined high threshold. The processing module deploys an instance-level classifier on the at least one shot candidate obtained using machine learning. The processing module computes the average loss on a validation dataset while generating the monitoring model through an iterative process until a predetermined minimal loss is achieved. In another embodiment of the present disclosure, the processing module performs post-processing on the at least one shot candidate using minimal cycle time and majority vote.

In specific embodiments of the present disclosure, the processing module selects projectile launcher monitoring parameters from at least one operating parameter, external parameters of the projectile launcher, or a combination thereof. The operating parameter is selected from moving parts speed, cycle rate, burst rate, schedule of firing, or combination thereof. The external parameter is selected from shooting sequence, ammunition type, ammunition load, gas-operated reloading nozzle size, shooter position, mounting mechanism, mounted accessories weight, ammunition loading type, usage of a suppressor, shooting angle, the projectile launcher and canon temperature, the projectile launcher dirtiness, the projectile launcher wear and tear, or combination thereof.

A second aspect of the present disclosure, is related to a method for training a projectile launcher monitoring comprises acquiring sensor signals from a sensor module corresponding to a shooting plan and converting them into a time-sampled data, processing the time sampled data to generate a monitoring model, wherein the step of processing the time-sampled data comprises the steps of producing at least one shot candidate from the time-sampled data when at least one metric is satisfied, deploying an instance-level classifier to categorize the at least one shot candidate to generate at least one prediction, computing an estimated proportion by aggregating the at least one prediction, comparing the estimated proportion with a real proportion to determine a loss function and generating the monitoring model through an iterative process until a predetermined minimal loss is achieved.

In specific embodiments of the present disclosure, the step of acquiring sensor signals from a sensor module corresponding to a shooting plan includes measuring acceleration of the projectile launcher at a predetermined sample rate.

In specific embodiments of the present disclosure, the step of producing at least one shot candidate from the time-sampled data comprises the step of calculating a rolling average of the squared acceleration in a predetermined time window and determining when the rolling average is transitioning from a predetermined low threshold to a predetermined high threshold.

In specific embodiments of the present disclosure, the step of deploying an instance-level classifier is performed using machine learning.

In specific embodiments of the present disclosure, the step of generating the monitoring model comprises the step of computing the average loss on a validation dataset through an iterative process until a predetermined minimal loss is achieved, wherein the validation dataset is constructed by using a random sampling, uniform sampling, or combination thereof.

In specific embodiments of the present disclosure, the method comprises the step of measuring the acceleration of the projectile launcher at a predetermined sample rate along with other operating and external parameters.

Another aspect of the present disclosure is related to a trained projectile launcher monitoring system, trained according to the second aspect of the present disclosure. The trained projectile launcher monitoring system comprises a sensor module to acquire signals and convert them into time-sampled data and a communication module to send and receive data to a processing module. The processing module classifies shot candidates based upon the instance-level classifier determined by the training method of the second aspect of the present disclosure.

BRIEF DESCRIPTION OF THE DRAWINGS

Various aspects, as well as embodiments of the present disclosure, are better understood by referring to the following detailed description. To better understand the present disclosure, the detailed description should be read in conjunction with the drawings.

DETAILED DESCRIPTION

Figure 1:
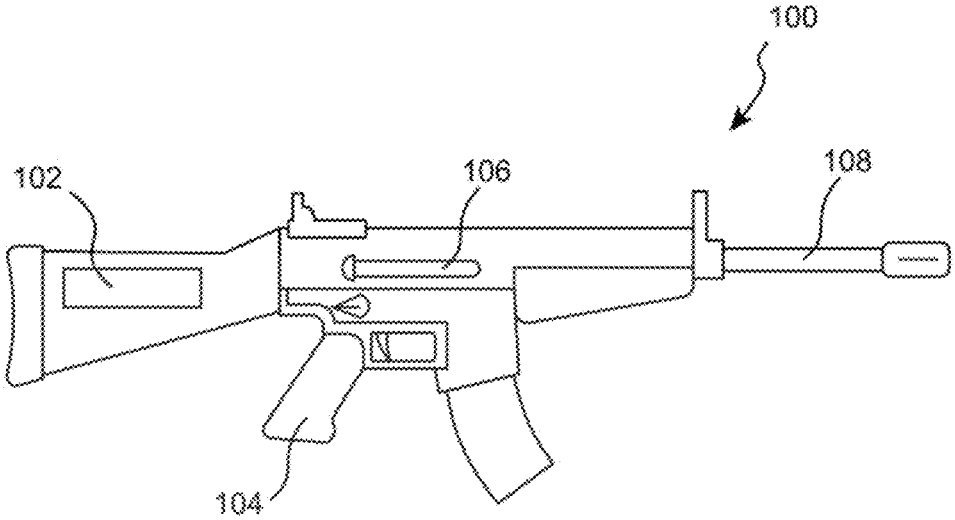
FIG. 1 is a schematic illustration of a projectile attachment constructed and operative in accordance with an embodiment of the present disclosure.

FIG. 1 is the schematic illustration of a projectile attachment 102 coupled to a projectile launcher 100. The projectile launcher 100 can be of any type and includes, but not limited to, a handgun, a rifle, a machine gun, a carbine, a submachine gun, a shotgun, a missile launcher, a rocket launcher, a grenade launcher, or any other weapon. FIG. 1 illustrates a projectile attachment 102 located in the stock of the projectile launcher 100.

The projectile attachment 102 can be positioned in the action 106, handle 104, or the barrel 108 of the projectile launcher 100. The projectile attachment 102 may also be coupled to accessories that are further attached to the projectile launcher. The accessories may include but are not limited to sights, scopes, lasers, or suppressors. The location and orientation of the projectile attachment 102 on the projectile launcher 100 are arbitrary and can be calibrated accordingly.

Figure 2:
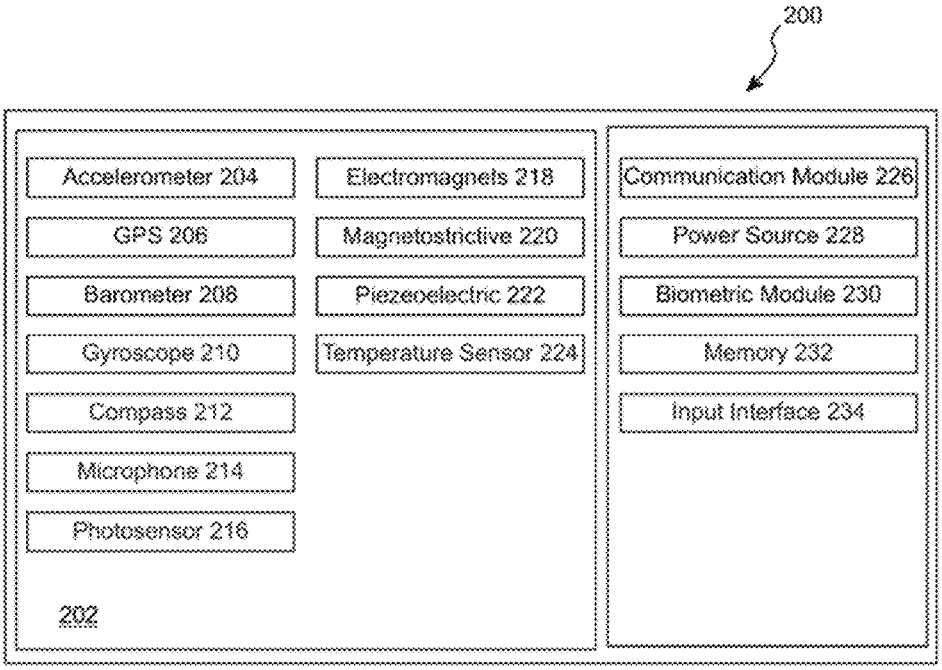
FIG. 2 illustrates a block diagram of a projectile attachment in accordance with an embodiment of the present disclosure.

FIG. 2 illustrates a block diagram of a projectile attachment 200 in accordance with an embodiment of the present disclosure. The projectile attachment 200 further includes at least one sensor module 202, a communication module 226, a power source 228, a biometric module 230, a memory 232 and an input interface 234.

The sensor module 202 is coupled with the projectile launcher to acquire sensor signals and convert them into time-sampled data. The sensor module 202 includes at least one acceleration sensor 204. The acceleration sensor 204 measures the acceleration of the projectile launcher at a predetermined sample rate. The acceleration sensor 204 provides information related to the motion and orientation of the projectile attachment 200. The sensor module 202 can include other sensors to capture operating parameters and external parameters of the projectile launcher. The sensors are selected from GPS sensor 206, barometer sensor 208, gyroscope sensor 210, compass sensor 212, microphone sensor 214, photosensor 216, electromagnet sensor 218, magnetostrictive sensor 220, piezoelectric sensor 222, temperature sensor 224, or a combination thereof.

The operating parameters are selected from moving parts speed, cycle rate, burst rate, schedule of firing, or combination thereof. The external parameters are selected from shooting sequence, ammunition type, ammunition load, gas-operated reloading nozzle size, shooter position, mounting mechanism, mounted accessories weight, ammunition loading type, usage of a suppressor, shooting angle, the projectile launcher and canon temperature, the projectile launcher dirtiness, the projectile launcher wear and tear, or combination thereof.

The communication module 226 includes a transceiver to enable the communication between the projectile attachment 200 and a processing module. The transceiver can be a wired or wireless transmitter/receiver. The transceiver may support Bluetooth, Near Field Communications (NFC), Wi-Fi, Cellular, or a combination thereof.

The power source 228 produces a voltage or current power to drive the projectile attachment 102. The power source 228 may be AC or DC and is selected from a group consisting of a battery, a Lithium-ion rechargeable battery, a fuel cell, and a combination thereof. Optionally, the projectile attachment can harness power from alternative energy sources such as solar or projectile launcher operational response such as vibration or mechanical movement of components.

The biometric module 230 captures the biometric identifier of the user and performs user authentication and validation, thereby preventing unauthorized access to the projectile launcher.

The memory 232 stores the user-specific data, projectile launcher data and monitoring data. The user-specific data includes, but is not limited to, user authentication data such as user ID, username, user profile. The projectile launcher data is the metadata of the launcher and includes the part number, serial number of the projectile launcher, and batch number of the ammunition. The algorithm to enable the functioning of the projectile attachment and monitored sensor data is stored in the memory 232 with secure memory encryption. The memory 232 is a combination of volatile and non-volatile memory elements to enable secure storage of algorithm and in-process data without any functionality loss.

The input interface 234 includes a touch panel and biometric scanner. The touch panel can be used to input the user-specific data and projectile launcher data. The touch panel can alert the user about defective parts or components of the projectile launcher.

Figure 3:
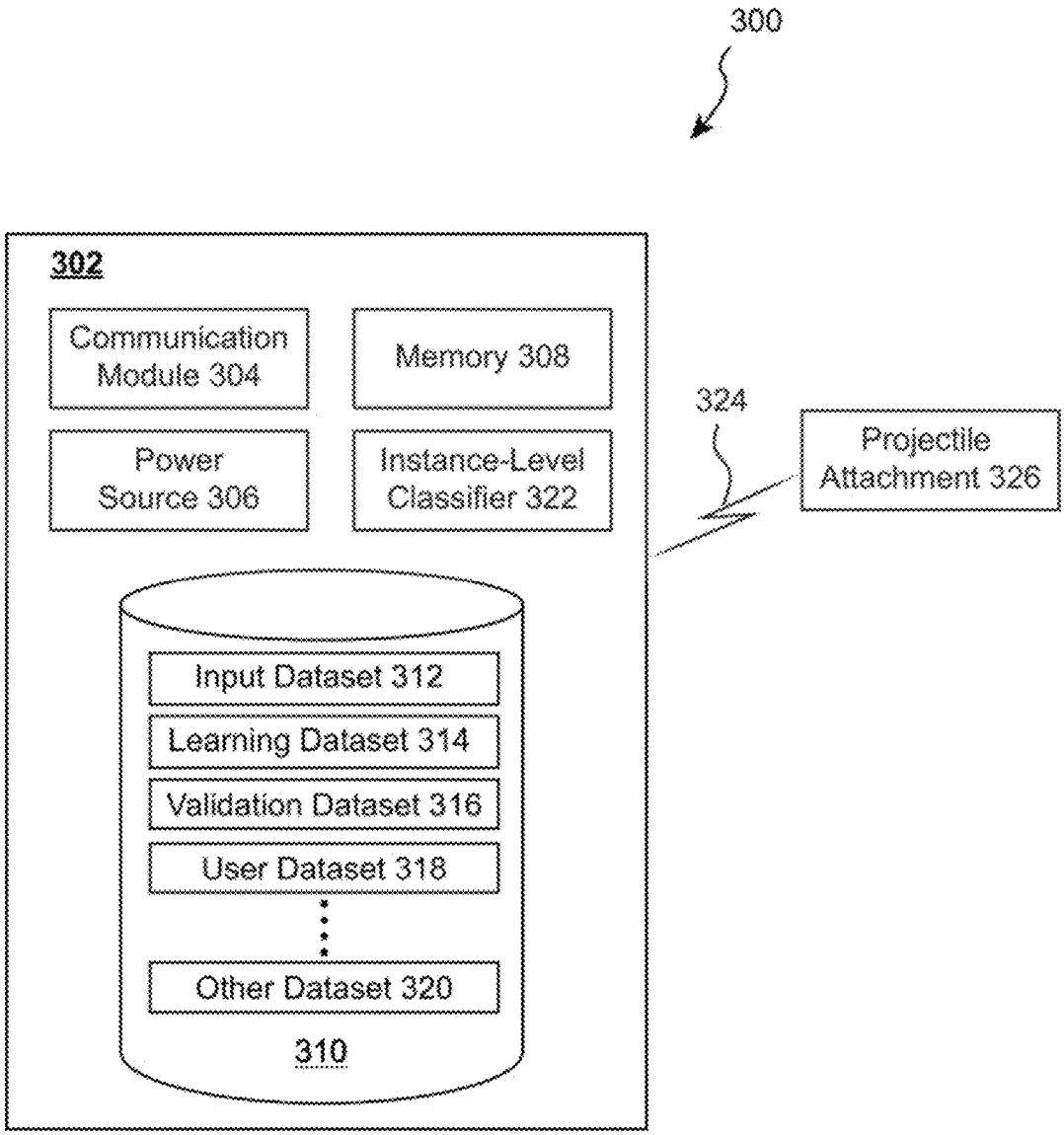
FIG. 3 illustrates an automated system for projectile launcher monitoring in accordance with an embodiment of the present disclosure.

FIG. 3 illustrates an automated system for projectile launcher monitoring in accordance with an embodiment of the present disclosure. The processing module 302 tracks and processes the time sampled sensor data received from the projectile attachment 326. The processing module 302 is capable of executing software instructions or algorithms to implement functional aspects of the present disclosure. The processing module can be any commercially available processor or a cloud system that can process the data received from the projectile attachment to derive a monitoring model. The processing module 302 can also be implemented as a Digital Signal Processor (DSP), a microcontroller, a designated System on Chip (SoC), an integrated circuit implemented with a Field Programmable Gate Array (FPGA), an Application Specific Integrated Circuit (ASIC), or a combination thereof. The processing module can be implemented using a co-processor for complex computational tasks. The processing module 302 may be integrated with the projectile attachment 326.

The processing module 302 includes a communication module 304, a power source 306, a memory 308, a database 310, and an instance-level classifier 322. The processing module 302 implements a machine-learning algorithm to generate a monitoring model, which can be deployed immediately in the field.

The communication module 304 includes a transceiver responsible for the communication exchange between the processing module 302 and the projectile attachment 326.

The power source 306 produces a voltage or current power to carry out the operations of the processing module 302. The power source 306 is AC or DC and is selected from a group consisting of a battery, a Lithium-ion rechargeable battery, a fuel cell, a grid power transformed, and a combination thereof.

The memory 308 is coupled with the processing module 302 and stores the machine learning algorithms and instructions. The memory 308 may include any of the volatile memory elements (for example, random access memory, such as DRAM, SRAM, SDRAM, etc.), non-volatile memory elements (for example, ROM, hard drive, etc.), and combinations thereof. The memory 308 may have a distributed architecture, where various components are situated remotely from one another but can be accessed by the processing module 302. The software in memory 308 can include one or more software programs, machine learning algorithms, each of which includes an ordered listing of executable instructions for implementing logical functions. Further, the processing module 302 can be implemented using a cloud architecture; wherein the processing module can interact with multiple projectile attachments to generate their respective monitoring models at the same time using multiple or a single instance.

The database 310 stores the data received from the projectile attachment 326 via a communication network 324. The database further includes an input dataset 312, a learning dataset 314, a validation dataset 316, and a user dataset 318. The input dataset 312 is configured to store the time-sampled data received from the projectile attachment 326 via a communication network 324. The learning dataset 314 receives the time-sampled data from the input dataset 312. The learning dataset 314 runs machine learning algorithms on the obtained time-sampled sensor data.

The validation dataset 316 is split from the input dataset 312 to evaluate the final performance of the model. The validation dataset 316 is the twin/replica of part of the input dataset 312. The information about the number and type of the shots available is used to construct the validation dataset 316 by using random sampling. In a first approach, to capture the behavior of the projectile launcher in a wide range of situations and to increase the performance of the model on real-world data, acquisitions are made in a systematic way by controlling a number of external variables. The sensor input series is associated with metadata indicating the state of the external parameters. This information is used to improve the generation of the validation dataset 316 by ensuring that at least one input series from each variable combination is part of the validation dataset 316. All known variable combinations are presented and optimized in the validation dataset 316. In a second approach, the rest of the validation dataset 316 is constructed either through uniform sampling for each combination or proportionally sampling the real-world frequency of each combination. The first approach is simple and optimizes for best performance across configurations. However, this approach over-represents the importance of extreme configurations. The second approach provides better real-world performance through better optimization for nominal usage but requires additional information from the users about their typical usage of the projectile launcher. Moreover, different users have a different distribution of configurations, and the best optimization is only obtained by considering the distribution for a specific user.

One drawback of the first approach is that it imposes a minimum size restriction on the validation dataset 316. The ranking of the external variable in order of importance eliminates the problem of minimal database size. Therefore, the validation dataset 316 only requires validation on all possible values for the important external variables. The validation dataset 316 is automatically constructed by recording the firing activity and the state of the external variables. The processing module 302 computes the average loss on a validation dataset 316 while generating the monitoring model through an iterative process until a predetermined minimal loss is achieved.

The user dataset 318 stores the user-specific data received from the projectile attachment 326. The user-specific data includes user ID, username, user biometric data, and weapon profile. The user dataset 318 also stores the data related to user authentication and validation. The user data can be used to predict user behavior and maintenance schedules based on their usage.

Figure 4:
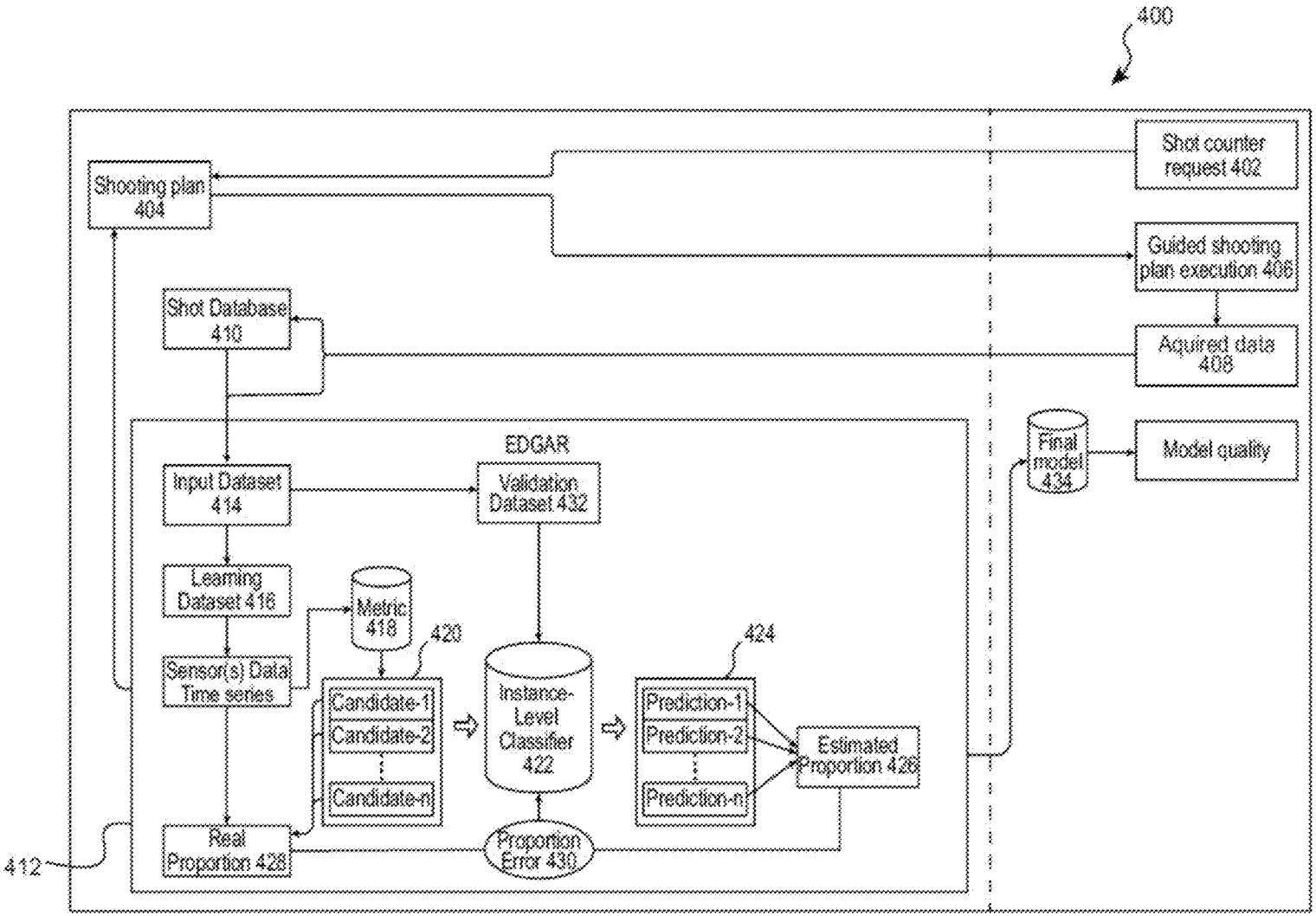
FIG. 4 illustrates a flowchart of an embedded detection of gunshots by AI in real-time in accordance with an embodiment of the present disclosure.

The other dataset 320 stores operating parameters and the external parameters of the projectile launcher, the data received from the learning dataset 314, and stores the real proportion of the time sampled sensor data required to compute loss function (as shown in FIG. 4). The other dataset 320 can also maintain a record of the projectile launcher data received from the projectile attachment 326, including the code and batch number of the ammunition used with the projectile launcher.

The instance-level classifier 322 deploys machine learning algorithms to automatically categorize a shot candidate from the received time sampled data as a non-shot, a shot with live ammunition, a shot with training ammunition, or any other prediction suitable for developing an automated monitoring model.

The communication network 324 communicatively couples the processing module 302 with the projectile attachment 326 and may include a wired or wireless network. The communication network 324 may support any number of suitable wireless data communication protocols, techniques, or methodologies, including RF (radio frequency), IrDA (infrared), Bluetooth, ZigBee (and other variants of the IEEE 802.15 protocol), WiFI/IEEE 802.11 (any variation), IEEE 802.16 (WiMAX or any other variation), Direct Sequence Spread Spectrum, Frequency Hopping Spread Spectrum, Long Term Evolution (LTE), cellular/wireless/cordless telecommunication protocols (e.g., 3G/4G, etc.), wireless home network communication protocols, satellite data communication protocols, GPRS, proprietary wireless data communication protocols such as variants of Wireless USB, and any other protocols for wireless communication.

The processing module 302 uses weak labels concerning the number of shots contained in time-sampled data. The weak labels eliminate the need for expert intervention to manually discern the unrelated shots.

FIG. 4 illustrates a flowchart of an embedded detection of gunshots by AI in real-time (EDGAR) in accordance with an embodiment of the present disclosure. The projectile attachment of the system for a projectile launcher monitoring receives a shooting plan 404 upon a request 402. The shooting plan is provided from a centralized system maintained by the manufacturer of the projectile launcher or a provider of the automated monitoring system. The shooting plan 404 gets designed based on the request 402 of the user from the projectile attachment. The request 402 provides projectile launcher type, client's use requirements, or other relevant data elements that are essential to design the shooting plan 404. The centralized system can use a learning data set for automatically defining the shooting plan 404 without any human intervention. The operator of the projectile launcher executes guided shooting plan 406 to build acquired data set 408 using the sensor module. The sensor module (not shown) comprises at least one acceleration sensor to acquire a plurality of measurements over time. The acceleration sensor measures the acceleration of the projectile launcher at a predetermined sample rate and produces a respective sampled time signal of values relating to the characteristic measured thereby. The time-sampled data corresponding to the guided shooting plan execution 406 is transmitted to the processing module 412 using the communication module via a shot database 410. The shot database 410 receives the time sampled data corresponding to guided shooting plan execution 406 and further feeds the time sampled data to the processing module 412, which implements the EDGAR technique to process the time sampled data for generating a monitoring model. The processing module 412 includes an input dataset 414, a learning dataset 416, a validation dataset 432, and an instance-level classifier 422. The input dataset 414 receives time-sampled data from the sensor module and provides the time-sampled data to the learning dataset 414. The processing module 412 runs the machine learning algorithm on the received time-sampled data and provides a learning dataset to train the model. The processing module 412 calculates a rolling average of the squared acceleration in a predetermined time window from the time-sampled data using:

$$m[t] = \frac{1}{w}\sum_{i=-w/2}^{w/2}(a[t+i+o])^2$$

Where a[t] is the input acceleration time series, w is a positive integer hyperparameter representing the size of the average window, and o is an optional integer applied to shift the position of the metric relative to the input signal. Successive values of m[t] are more efficiently computed using:

$$m[t] = m[t-1] + \frac{1}{w}\left(a\left[t+\frac{w}{2}+o\right]\right)^2 - \frac{1}{w}\left(a\left[\left(t-\frac{w}{2}-1\right)+o\right]\right)^2$$

Figure 6:
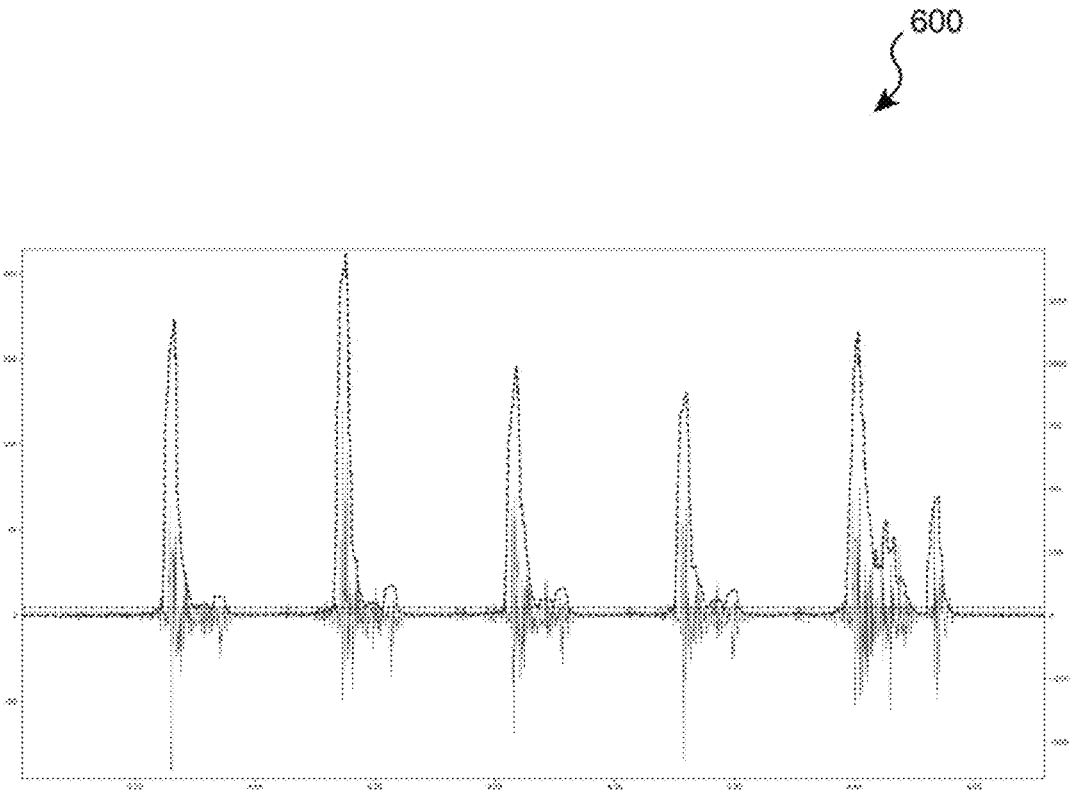
FIG. 6 illustrates a graph for the evolution of the metric on a typical accelerometer input in accordance with an embodiment of the present disclosure.
Figure 7:
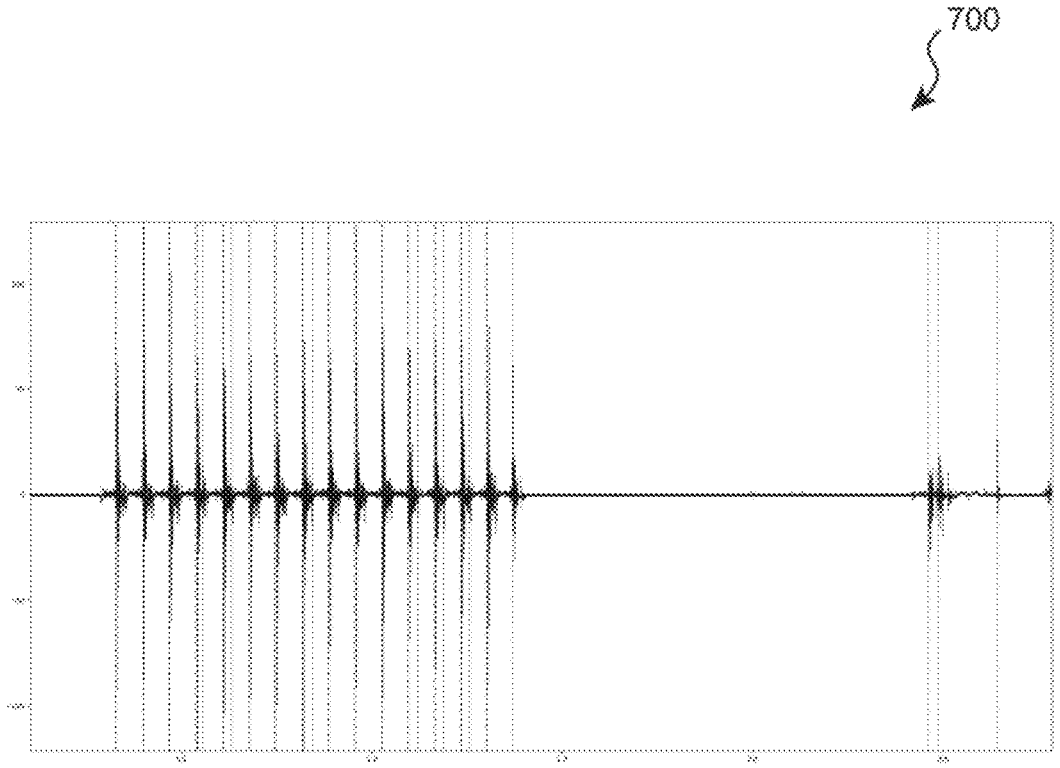
FIG. 7 illustrates a graph for candidate generation from the metric in accordance with an embodiment of the present disclosure.

The processing module 412 only obtains weak labels from the time-sampled data to train the monitoring model. The weak labels represent the number of the shots of each type contained in the time-sampled data. The processing module 412 further determines the occurrence of the at least one shot candidate 420 (candidate1, candidate2, . . . , candidateN) when the rolling average is transitioning from a predetermined low threshold to a predetermined high threshold. The processing module 412 generates the at least one shot candidate 420 from the time sampled data when at least one metric 416 is satisfied (as shown in FIG. 6 and FIG. 7).

The processing module 412 further deploys an instance-level classifier 422 to categorize at least one shot candidate. The accelerometer time sampled data including a shooting sequence with different counts $c_i$ with $i \in \{1, \ldots, N\}$ is the number of occurrences of each category of the event. The time sampled data is divided into an ensemble of candidate slices x. Further, the event proportions between the known number of events of a certain category and the total number of candidates is defined as:

$$p_i = \frac{c_i}{|\mathbb{X}|}$$

The instance-level classifier 422 $f_\theta(x)$ with trainable parameters θ automatically classifies the at least one shot candidate 420 to generate at least one prediction 424 (prediction 1, prediction 2, . . . prediction N) and classify it into a corresponding category such as non-shot, shot with live ammunition, and shot with training ammunition, or other available categories. Further, the predictions over a time series are aggregated to compute an estimated proportion 426. The resulting predictions 424 over a given time series are aggregated into proportions as follows:

$$\hat{p} = \frac{1}{|\mathbb{X}|}\sum_{x\in\mathbb{X}} f_\theta(x)$$

The estimated proportion 426 is compared with a real proportion 428 in order to tune the trainable parameters θ to optimal values. The processing module 412 computes the average loss on the validation dataset 432 while generating the monitoring model through an iterative process until a predetermined minimal loss is achieved. In particular, a loss function 430 is computed using:

$$\mathcal{L}_{prop} = -\sum_{i=1}^{N} p_i \log(\hat{p}_i) + \sum_{i=1}^{N} p_i \log(p_i)$$

where $p_i$ is the real proportion between a category of shot and the number of candidates and $\hat{p}_i$ is the corresponding proportion as inferred by the instance-level classifier 422.

The second term allows the loss function 430 to converge to 0 in the case of perfect predictions (i.e., when $\hat{p}=p$). Without it, the minimal achievable loss has different values depending on the ratio of the different proportions. This results in a comparison of loss values across different inputs more meaningful, as well as the aggregation in an average loss over the dataset. The average loss is a smooth metric of model quality, whereas model accuracy takes discrete values corresponding to a discrete number of counting errors. Further, the processing module 412 also performs post-processing on the at least one shot candidate using minimal cycle time and majority vote.

Filtering out the candidates at the metric level results in the possibility of removing the candidate that typically corresponds to the shot, hence leading the model to non-detection. A better approach is to apply the filtering after the network predictions. A first approach is to change successive shot predictions to non-shot if they fall within an exclusion window of the first prediction. This leads to a significant reduction in the error rate. In addition, avoidance of performing model inference on the ignored predictions leads to an overall computational performance increase in deployment. A drawback of implementing a post-processing step may be that model remains penalized during training for the duplicate predictions. A model is produced which is reluctant to predict shots. If the model has knowledge of the post-filtering, it may predict a shot for slightly offset candidates, knowing that it will not be penalized for duplicate predictions. Algorithm 1 is implemented to accomplish the training. This corrects the predictions while ensuring the duplicates do not take part in the loss computation. The process is performed in an iterative manner since a masked-out shot prediction must not itself create a mask. This leads to a significant reduction in the error rate.

Algorithm 1 Remove duplicate predictions in training

Require: $t_i$: timestamp for each candidate $x_i$.
Require: $T_M$: minimum event duration
Require: $f_\theta(x)$: instance-level classifier with trainable parameters $\theta$,
Requires e: vector corresponding to a non-shot prediction with maximum certainty
$\hat{y}_i \leftarrow \max_{1 \le k \le N} f_\theta(x)_{i,k}$ ▷ Individual category predictions
$m_i \leftarrow T$ ▷ Mask to be computed
for $i = 1, \ldots, |x|$ do $$\hat{y}'_j \leftarrow \begin{cases} \hat{y}_j, & \text{if } m_j \\ 0, & \text{if } \neg m_j \end{cases}, \; j \in \{1, \ldots, |x|\}$$

if $\hat{y}'_i$ predicts a shot then
$\text{update}_j \leftarrow (t_j \le t_i) \vee (t_j > t_i + T_M), \; j \in \{1, \ldots, |x|\}$
$m \leftarrow m \wedge \text{update}$
end if
end for $$f'_\theta(x)_j \leftarrow \begin{cases} f_\theta(x)_j, & \text{if } m_j \\ e, & \text{if } \neg m_j \end{cases}, \; j \in \{1, \ldots, |x|\}$$

return $f'_\theta(x)$

The majority vote is conducted to improve the overall discrimination performance. Another physical restriction is the time needed to switch the projectile launcher from one configuration to another when specific accessories need to be mounted on the platform. Switching from firing live rounds to blank rounds usually requires the addition of a blank-firing adaptor at the end of the barrel for both functional and safety reasons. A similar operation is required when switching to and from the use of a suppressor. This indicates that all shots detected in a burst belong to the same projectile launcher configuration. In addition, the physical process of affixing the required accessory to the projectile launcher takes a minimal amount of time. The switching operations are not safe to perform shortly after the projectile launcher is operated. The operator needs to wait until the barrel is cooled down to safe handling temperatures. As a result, as long as the interval between detected shots is lower than this minimum configuration swapping time, detected shots belong to the same projectile launcher configuration. This information is used to improve the overall discrimination performance by performing majority vote on the detected shot classes. The individual predictions are accumulated until no shot is detected for a timespan longer than the minimum possible time to switch configurations. All pending predictions are permanently recorded with the ammunition type of the majority. The system is further improved by applying weights on the individual predictions depending on their quality. If sufficient shots are available, the shots that are not fully observed (such as those happening on device wakeup) are discarded. A more precise weighing is performed if the model associates the prediction with a level of confidence indicator. A final ready-to-implement model 434 is delivered to the projectile attachment (not shown in FIG. 4).

Figure 5:
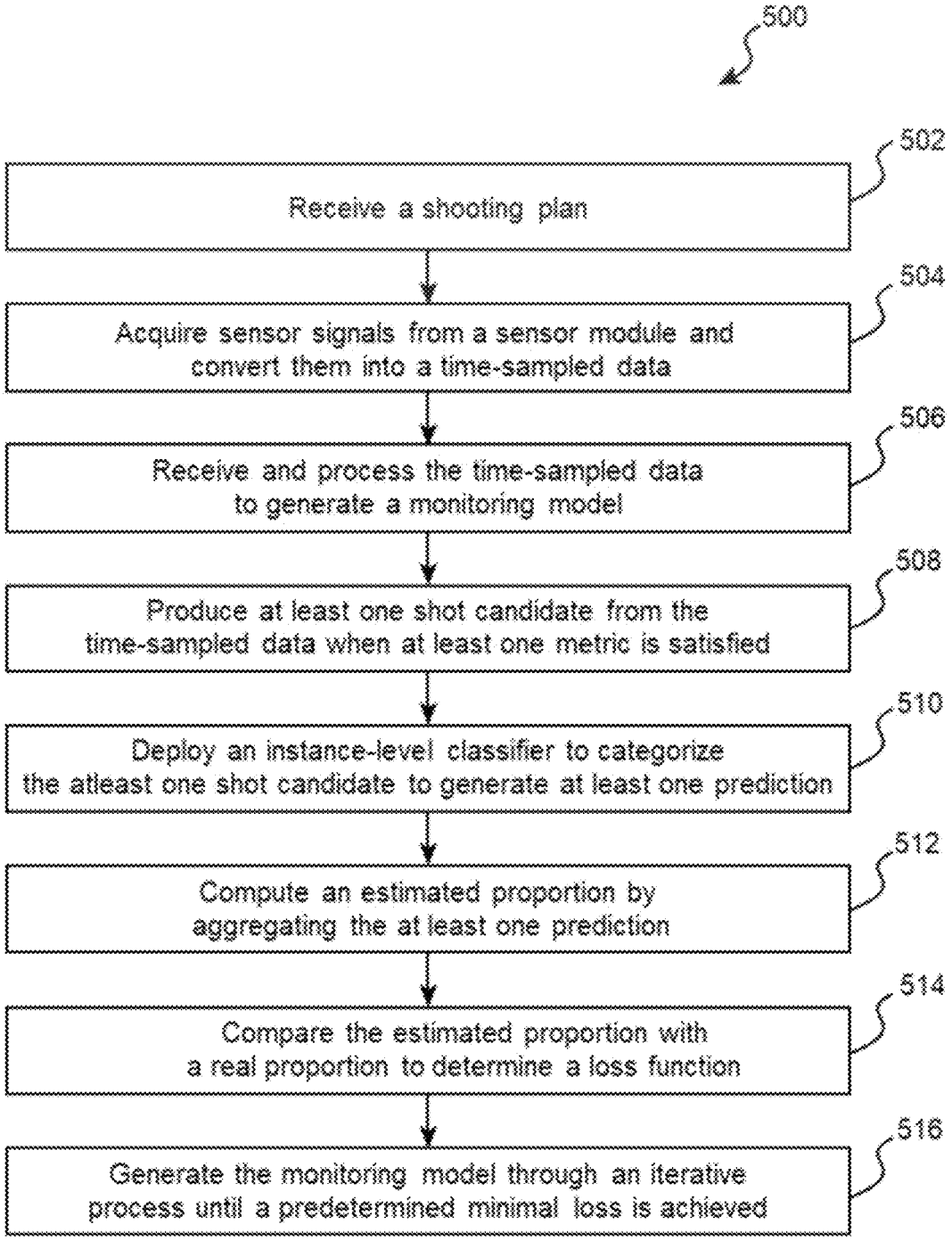
FIG. 5 illustrates a flowchart of a method for a projectile launcher monitoring in accordance with an embodiment of the present disclosure.

A flowchart of a method for automated projectile launcher monitoring implemented by a system for projectile launcher monitoring according to the present disclosure is illustrated in FIG. 5. The method comprises the steps of:

i. receiving (502) a shooting plan;
ii. acquiring (504) sensor signals according to the shooting plan from a sensor module and converting them into time-sampled data;
iii. receiving and processing (506) the time-sampled data to generate a monitoring model;
iv. producing (508) at least one shot candidate from the time-sampled data when at least one metric is satisfied;
v. deploying (510) an instance-level classifier to categorize the at least one shot candidate to generate at least one prediction;
vi. computing (512) an estimated proportion by aggregating the at least one prediction;
vii. comparing (514) the estimated proportion with a real proportion to determine a loss function; and
viii. generating (516) the monitoring model through an iterative process until a predetermined minimal loss is achieved.

FIG. 6 illustrates a graph 600 of the evolution of the metric (dashed line) based on an accelerometer input in accordance with an embodiment of the present disclosure. To reduce the human intervention to a minimal level, only weak labels in the form of a total ammunition count per time series are obtained. The system leverages the weak label information to derive a machine learning algorithm by exploiting the weak labels to train the neural network model. This is accomplished by reformulating the counting problem into a category proportion problem. In order to do so, while keeping a detector with suitable time and space constraints for embedded use, the following two features are used:

1. A shot has a finite and known maximum duration.
2. At least one sub-event of a shooting event always be reliably distinguished from the background noise.

The first feature relates to the size of the time of candidate windows. Since it imposes no bound on the maximum duration, a sufficiently large number exists to satisfy it. However, larger numbers negatively impact the performance of the resulting detector. A good number is easily derived from the minimum theoretical burst rate of the projectile launcher.

The second feature relates to reducing the number of candidate windows taken into consideration. The system produces candidate windows only when a certain metric is satisfied. This prevents performing useless computations during rest periods where the only input is background noise. The difference between the metric and the detector is that the metric is not subject to any constraint on the number of false positives it provides, although a metric with fewer false positives reduces the computation time. It is important to avoid the false negatives in the metric, which results in a valid candidate not being presented to the detector. At the extreme, the feature is discarded in favor of having to consider candidates at fixed, high-frequency intervals, rendering the problem too complex to be computed on a projectile launcher.

The second feature depends on the nature of the input signal. The processing module receives the time-sampled data from the sensor module of the projectile attachment. The processing module calculates the rolling average on the instantaneous accelerations squared in a predetermined time window using:

$$m[t] = \frac{1}{w}\sum_{i=-w/2}^{w/2}(a[t+i+o])^2$$

Where a[t] is the input acceleration time series, w is a positive integer hyperparameter representing the size of the average window, and o is an optional integer applied to shift the position of the metric relative to the input signal. Successive values of m[t] are more efficiently computed using:

$$m[t] = m[t-1] + \frac{1}{w}\left(a\left[t+\frac{w}{2}+o\right]\right)^2 - \frac{1}{w}\left(a\left[\left(t-\frac{w}{2}-1\right)+o\right]\right)^2$$

FIG. 7 illustrates a graph 700 of candidate generation from the metric in accordance with an embodiment of the present disclosure. The metric generated is compared to the accelerometer time-sampled signal. The processing module determines the occurrence of the at least one shot candidate when the rolling average is transitioning from a predetermined low threshold to a predetermined high threshold. Vertical lines indicate the generation of candidates from the metric. The generated candidates define a slice of the time-sampled signal of a fixed size. A smaller input vector provides better classification results and a major benefit in terms of inference time performance.

A metric is continuously computed based on the continuous time-sampled sensor data. When a candidate is detected corresponding to a metric, the isolated input vector is provided to the classifier to categorize it into a corresponding class. The input vector is chosen as small as error rate requirements allow, usually significantly smaller than the cycle time of the projectile launcher. Real-time interactive reporting is allowed when the total inference time of the classifier for both shot and non-shot candidates is also under the cycle period of the projectile launcher.

The total computation time depends on both the intrinsic behavior of the projectile launcher and on the quality of the metric used. The total time is estimated from a representative sample of active periods for the considered projectile launcher. For C candidates in a time series with timestamps $t_i$, the candidate's frequency curve is estimated by using:

$$\frac{C-1}{t_C - t_1}$$

In a typical spectrum of candidate frequencies with the previously described metric, a long tail effect from rare weapon configurations which produce a large number of non-shot candidates can be observed. An inference budget lower than a certain percentage of the event frequencies is chosen to ensure the inference occurs in real-time in most configurations and has only a quickly recoverable lag in the rare remaining configurations.

Figure 8:
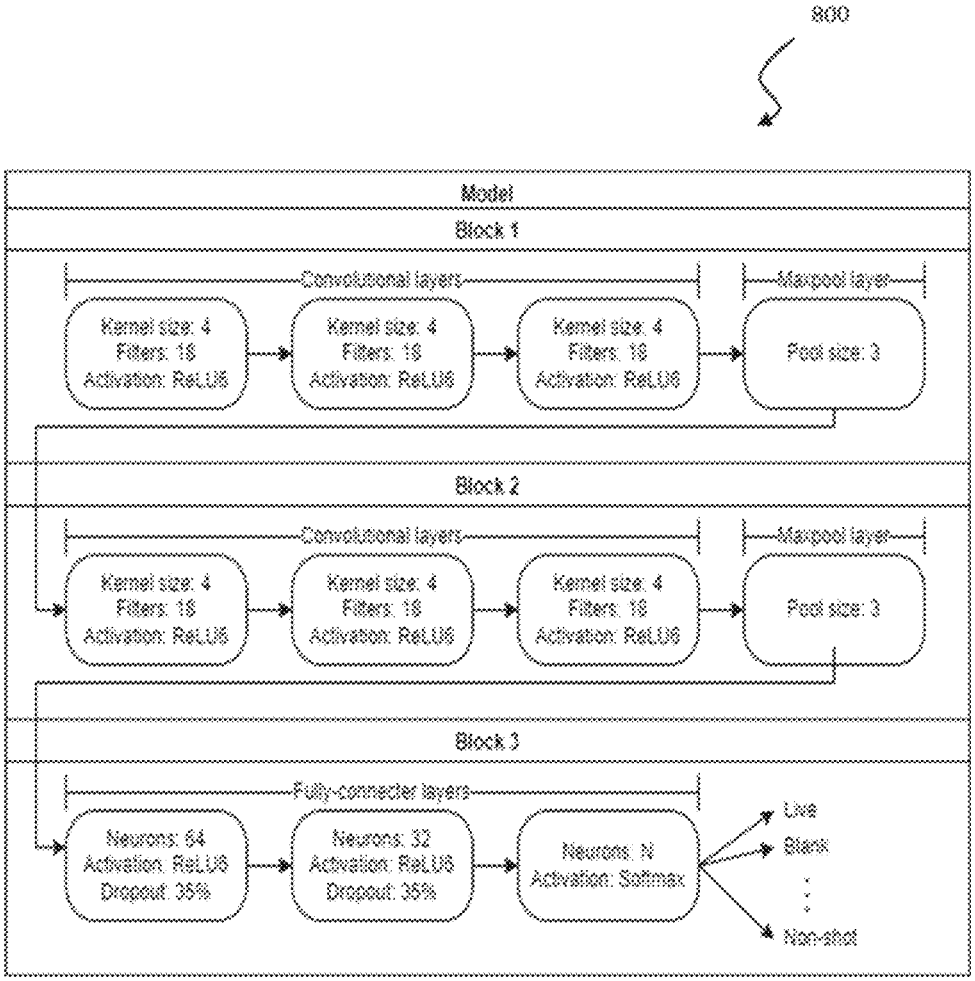
FIG. 8 illustrates a neural network model implemented in an automated system for a projectile launcher monitoring in accordance with an embodiment of the present disclosure.

FIG. 8 illustrates a neural network model 800 implemented in an automated system for a projectile launcher monitoring according to the present disclosure. The basic technique and loss function improvements described above are independent of the trained model. A convolutional neural network (CNN) model is chosen to predict the shot detection. Depth-wise separable CNNs (DS-CNN) or wide first layer kernels CNNs (WDCNN) are considered alternatives to the CNN model. The proposed system focuses on instance-level information, and the implementation of long short-term memory (LSTM) networks provides an extension to add contextual information to the prediction.

Embedded applications/machine learning algorithms impose hard restrictions on available energy and computing power. Therefore, the projectile launcher monitoring algorithms are deployed on low-cost generic microcontrollers. The low-cost generic microcontrollers provide limited support for floating-point operations. In order to leverage most of the available computing power, a quantization of the neural network is performed to operate on integer values. The use of smaller fixed-point integer representations (16 or 8 bits over the usual 32) reduces the size of the neural network and potentially improves inference time where more efficient low-level operations are available for smaller integer values.

However, blindly quantizing the neural network introduces rounding and saturation effects within the neural network, thereby lowering the accuracy of the neural network. Therefore, to achieve high practical performance, the system deploys a quantization scheme considering the distribution of weights, biases, and activations within the neural network on a representative input sample, optimizing the allocation of the number of bits between the fractional and exponential part of fixed-point representations. Moreover, the system implements quantization-aware training that simulates artificial quantization effects during the learning phase. This enables the system to adopt a neural network structure that, at the very least, mitigates and leverages the effects of quantization.

FIG. 8 illustrates an exemplary implementation of the basic structure of the neural network more suitable for quantization. The neural network structure includes ReLU6 (modified Rectified Linear Unit, with activation value limited to 6) activation layers in lieu of more usual ReLU (Rectified Linear Unit) activations. The classical ReLU activation is unbounded for positive values. Thereby, the range of activation values is wide. In contrast, the ReLU6 activation bounds the values, limiting their possible range. This allows the user to use a fixed-point representation with more bits allowed to the fractional part, reducing the quantization artifacts and improving overall accuracy.

In one implementation, the maximum value of 6 has been shown to produce the best median results, whereas ReLU2 can be implemented to achieve the best-case performance. Further, a low percentage of values actually falls near the bounds when the distribution of activation values uses the full range. Therefore, an implementation for better performance includes quantizing a 2-bits range around the average, saturating the outliers while leaving one more bit to be used in the fractional part.

The input vectors of the neural network are candidates generated according to a metric. The size of these candidates is based on the maximum possible duration of a shooting event. The reduction in input vector size improves the model accuracy. While the potential accuracy improvement is marginal, reducing the input vector size leads to a proportional reduction in the number of parameters in the first fully connected layer (the other layers remaining unchanged). It provides a major reduction in inference time and memory footprint of the final model. The input vector size cannot be reduced below a predetermined threshold (dependent on the selected projectile launcher and metric) as it may lead to loss of critical information of a shooting event and reduces the prediction accuracy of the neural network model.

In the case of large input vectors, two shots that are identical result in different input vectors depending on subsequent events. This results in additional signal complexity. This contextual information is used to improve predictions (e.g., a candidate is more likely to be a shot if another shot is observed occurring soon after).

This technique is fundamentally different from the current state of the art, for which the most important part of shot detection is the succession of events (shock/impacts) until the whole cycle of the projectile launcher is completed. When a smaller input vector is used, the initial part of the signal after the ignition event is taken into consideration, thereby leveraging the more complex information of the ignition event to perform the shot detection, ignoring the subsequent events resulting from the cycling.

The processing module filters out the candidates closely following a confirmed shot and leads to reduced overall computational requirements for inference. It is possible to evaluate several candidates close to each other without being able to do any filtering in case of no actual shot, or the last candidate needs to be evaluated. The suggested neural network starts with a series of convolutional layers using filters of relatively small kernel size. The first two blocks of convolution and pooling operations account for the vast majority (about 95% for practical input sizes) of the inference computational cost.

In case of close candidates, the corresponding output vectors show significant overlap. The result of the convolution operations on this overlap (barring some relatively small padding effects at the edges) is identical for all candidates. For any type of projectile launcher taken into consideration, the processing power is a much more limiting factor than memory footprint. The system may achieve a trade-off between space and speed by caching the results of convolutional operations to be reused by a potential overlapping candidate. If the available memory would not allow to cache the whole results, a possible compromise can be to cache only partial results starting with those at the end of the input vector. The system utilizes different technologies available in the state-of-the-art to reduce overall computational requirements.

In another implementation of the system, ammunition type discrimination is prioritized after the accurate shot counting. After achieving the accuracy in shot counting, the neural network attempt to predict ammunition type. The loss function and the corresponding neural network are extended from counting to discrimination by increasing the number of output classes (N) taken into consideration. However, as the non-shot class becomes just one of many, the loss function emphasizes more on the discrimination accuracy over the counting accuracy. The information about projectile launcher usage and degradation given by accurate shot detection is much more important than the information given by discrimination.

To alleviate this issue, a new hyperparameter $\alpha$ is introduced to balance the competing objectives:

$$\mathcal{L}_{prop} = L_{counting} + \alpha L_{discrimation},\ \alpha \in ]0, 1]$$

Where $\hat{p}_1$ is the proportion of non-shot candidates, we can define a new set of proportions that recovers the original counting problem by summing the proportion of all shot-type classes.

$$p' = \left\{p_1, \sum_{i=2}^{N} p_i\right\},\ \hat{p}' = \left\{\hat{p}_1, \sum_{i=2}^{N} \hat{p}_i\right\}$$

The counting loss is defined by using reduced proportions:

$$\mathcal{L}_{counting} = -\sum_{i=1}^{2} p_i' \log(\hat{p}_i') + \sum_{i=1}^{2} p_i' \log(p_i')$$

The discrimination loss uses the original formulation:

$$\mathcal{L}_{discrimation} = -\sum_{i=1}^{N} p_i \log(\hat{p}_i) + \sum_{i=1}^{N} p_i \log(p_i)$$

The value of $\alpha$ can be calibrated, revealing a Pareto front between counting and discrimination accuracy to be chosen from. Further, the non-shot proportion from the discrimination loss can also be excluded to calibrate $\alpha$. The discrimination performance over longer sequences of shots can also be improved through a majority vote. As a result, a sufficiently high base discrimination accuracy quickly leads to almost perfect practical accuracy. It further allows to calibrate $\alpha$ to improve counting accuracy without the visible impact of practical discrimination accuracy.

Figure 9:
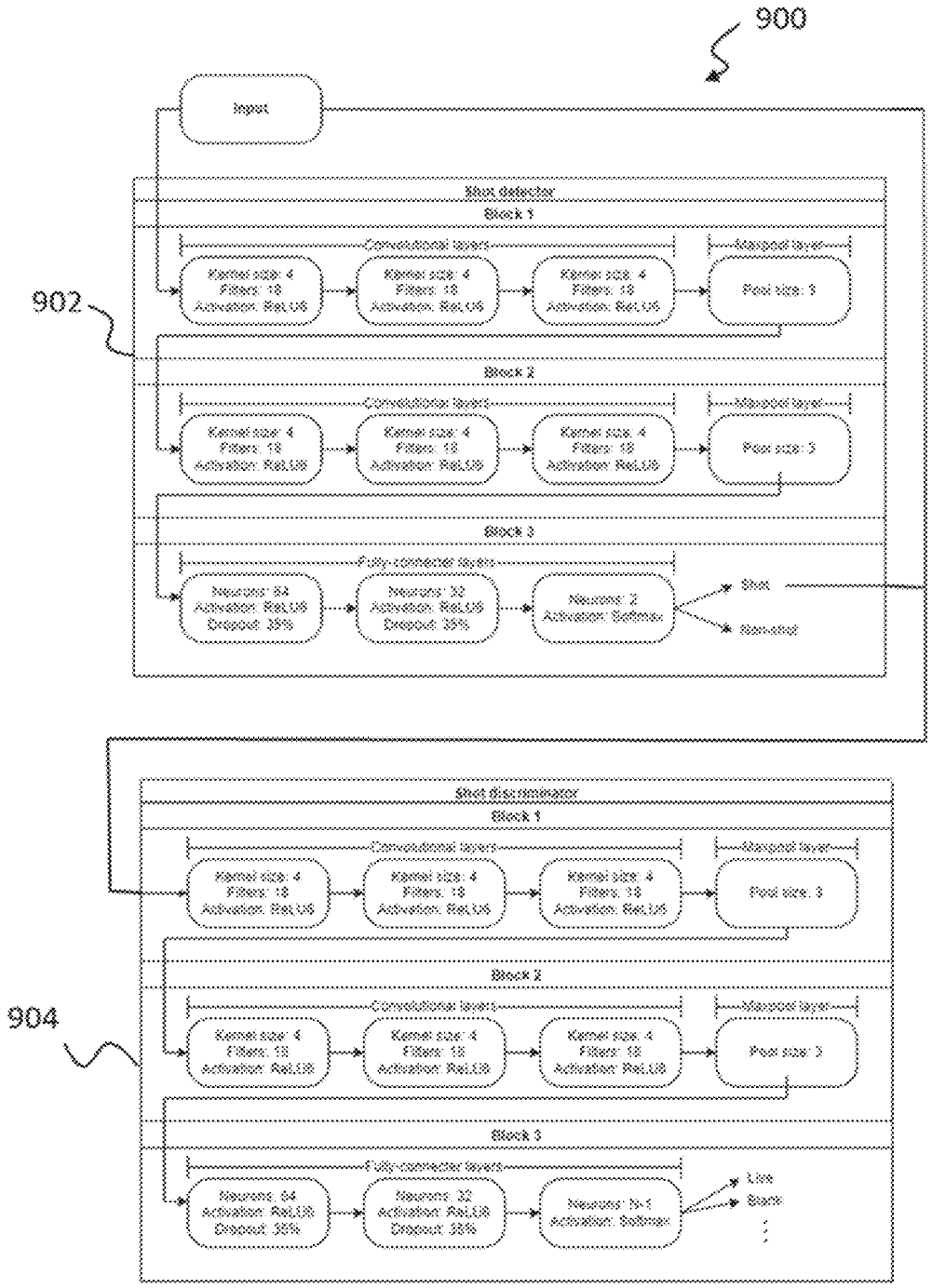
FIG. 9 illustrates a two-step neural network structure for shot discrimination in accordance with an embodiment of the present disclosure.

FIG. 9 illustrates the two-step neural network structure 900 for shot discrimination. A significant improvement is made by splitting the neural network shown in FIG. 8 into a two-step process. In the new neural network structure, a first part 902 of the network is run on every candidate and is only tasked with the counting sub-problem. If the candidate is confirmed as being a shot, then only the input vector is fed into a second 904 similar network which is tasked with the discrimination sub-problem. This technique shows several advantages:

1. The two networks are defined and trained independently. The optimal counting model is thus derived first and locked down to ensure this optimal accuracy independently from the discrimination feature. The distribution of the computational budget between the two features thereby made explicit. This leads to higher customization as per the implementation needs.
2. To reduce development lead time, one could envision deploying a counting-only model before deriving the discrimination model. The supplementary feature could then be deployed later as a firmware update.
3. While the original technique works on time series containing mixed classes, it is feasible to ensure that each time series contains only one type of ammunition. The type of ammunition is ensured at the level of the shooting plan and automatically managed. The problem treated by the discrimination network then becomes a fully supervised problem, enabling leveraging of more common classification techniques. In particular, the loss function is replaced with a classic cross-entropy function. A desirable effect is that the discrimination network requires a significantly lower training time due to the lower training complexity.

4. Experimental results have shown that for similar counting accuracy, two-step networks systematically outperform single-step networks even when those are larger by orders of magnitude.

The computational budget allocated to the second network is derived from the remaining computational power left by the higher priority counting network. The discrimination network only needs to be run on candidates which have been confirmed as shots by the counting network. If non-shot candidates represent a proportion $\lambda$ of the total number of candidates, for a total computational budget B and a counting budget $B_C$, a better estimate of the discrimination budget $B_D$ is made as follows:

$$B = \lambda(B_C + B_D) + (1 - \lambda)B_C \Leftrightarrow B_D = \frac{B - B_C}{\lambda}$$

An even more precise estimate of the discrimination budget is obtained from an individual inspection of the sensor time series of a representative time-sampled data. This enables checking what percentage of the input population is satisfied with a given discrimination budget. Then, an iterative optimization is applied to find the maximal discrimination budget that satisfies the minimum required percentage of the input series.

The descriptions are merely example implementations of this application but are not intended to limit the protection scope of this application. A person with ordinary skills in the art may recognize substantially equivalent structures or substantially equivalent acts to achieve the same results in the same manner, or in a dissimilar manner, the exemplary embodiment should not be interpreted as limiting the present disclosure to one embodiment. All features of all embodiments may be combined to create embodiments that are not described but are covered by the claims.

The invention claimed is:

1. An automated system (300) for monitoring a projectile launcher, the automated system comprising:

a sensor module (202), configured to be coupled with the projectile launcher to acquire signals and convert the signals into time-sampled data;

a communication module (226) configured to receive a shooting plan (404) and send the time-sampled data corresponding to the shooting plan (404) using the sensor module (202); and a processing module (302,412) configured to receive and process the time-sampled data from the communication module (226) to generate a monitoring model (434), wherein the processing module (302,412) is further configured to:

produce at least one shot candidate (420) from the time-sampled data when at least one metric (418) is satisfied, deploy an instance-level classifier (322,422) to categorize the at least one shot candidate (420) to generate at least one prediction (424), compute an estimated proportion (426) by aggregating the at least one prediction (424), compare the estimated proportion (426) with a real proportion (428) to determine a loss function (430), and generate the monitoring model (434) through an iterative process until a predetermined minimal loss is achieved.

2. The system according to claim 1, wherein the sensor module (202) includes at least one acceleration sensor (204).

3. The system according to claim 2, wherein the acceleration sensor (204) measures the acceleration of the projectile launcher at a predetermined sample rate.

4. The system according to claim 1, wherein the processing module (302,412) is configured to calculate a rolling average of the squared acceleration in a predetermined time window.

5. The system according to claim 4, wherein the processing module (302,412) is configured to determine an occurrence of the at least one shot candidate (420) when the rolling average is transitioning from a predetermined low threshold to a predetermined high threshold.

6. The system according to claim 1, wherein the instance-level classifier (322,422) is obtained by using machine learning.

7. The system according to claim 1, wherein the processing module (302,412) is configured to compute the loss function (430) using $$\mathcal{L}_{prop} = -\sum_{i=1}^{N} p_i \log(\hat{p}_i) + \sum_{i=1}^{N} p_i \log(p_i)$$

where $p_i$ is the real proportion (428) between a category of shot and the number of candidates and $\hat{p}_i$ is the corresponding proportion (426) as inferred by the instance-level classifier (322,422).

8. The system according to claim 1, wherein the processing module (302,412) is configured to compute an average loss on a validation dataset (316,432) while generating the monitoring model (434) through an iterative process until a predetermined minimal loss is achieved.

9. The system according to claim 1, wherein the processing module (302,412) is configured to perform post-processing on the at least one shot candidate (420) using minimal cycle time and majority vote.

10. The system according to claim 1, wherein the shooting plan (404) is derived using a predefined dataset.

11. The system according to claim 1, wherein the processing module (302,412) is configured to acquire supplementary data (408) corresponding to the shooting plan (404).

12. The system according to claim 1, wherein the processing module (302,412) is configured to select projectile launcher monitoring parameters from at least one operating parameter, from at least one external parameter of the projectile launcher, or from a combination of at least one operating parameter and at least one external parameter of the projectile launcher.

13. The system according to claim 12, wherein the at least one operating parameter includes moving parts speed, cycle rate, burst rate, and/or schedule of firing.

14. The system according to claim 12, wherein the at least one external parameter includes shooting sequence, ammunition type, ammunition load, gas-operated reloading nozzle size, shooter position, mounting mechanism, mounted accessories weight, ammunition loading type, usage of a suppressor, shooting angle, projectile launcher and canon temperature, projectile launcher dirtiness, and/or projectile launcher wear and tear.

15. The system according to claim 1, wherein the processing module (302,412) is configured to obtain weak labels from the time-sampled data to train the monitoring model (434).

* * * * *